US005277565A

United States Patent [19]

Schellekens et al.

[11] Patent Number: 5,277,565

[45] Date of Patent: Jan. 11, 1994

[54] ROTARY PUMP WITH SIMPLIFIED PUMP HOUSING

[75] Inventors: Antonius L. H. Schellekens, Tilburg; Johannes T. G. Gunsing, Eindhoven, both of Netherlands

[73] Assignee: Van Doorne's Transmissie B.V., Tilburg, Netherlands

[21] Appl. No.: 6,131

[22] Filed: Jan. 19, 1993

[30] Foreign Application Priority Data

Feb. 3, 1992 [NL] Netherlands ..... 9200193

[51] Int. Cl.[5] ..... F01K 19/08

[52] U.S. Cl. ..... 418/133

[58] Field of Search ..... 418/133

[56] References Cited

U.S. PATENT DOCUMENTS

| | | | |
|---|---|---|---|
| 1,989,900 | 2/1935 | Vickers | 418/238 |
| 2,766,700 | 10/1956 | Klessig | 418/133 |
| 2,861,517 | 11/1958 | Neff | 418/2 |
| 4,264,288 | 4/1981 | Wüstof et al. | 418/133 |
| 4,416,598 | 11/1983 | Merz | 418/133 |
| 5,171,131 | 12/1992 | Niemiec | 418/133 |

FOREIGN PATENT DOCUMENTS 0265774 5/1988 European Pat. Off. .

*Primary Examiner*—Edward K. Look
*Assistant Examiner*—Charles G. Freay
*Attorney, Agent, or Firm*—Young & Thompson

[57] ABSTRACT

A rotary pump is provided with a pump housing, a rotor situated in the pump housing and rotatable by means of a drive shaft, and also blade elements which are accommodated so that they can slide in grooves on the periphery of the rotor, and which interact in a sealing manner with a fixed cam surface. The pump housing is composed of three pump housing parts tightly connected to each other, the central pump housing part containing the cam surface. In order to simplify the housing, a port plate is provided with supply ports and discharge ports and accommodated in the central pump housing part. Preferably, the blade elements rest with one of their sides faces against an end face which is formed by the inward-facing surface of an outer pump housing part.

9 Claims, 2 Drawing Sheets

ROTARY PUMP WITH SIMPLIFIED PUMP HOUSING

The invention relates to a rotary pump provided with a pump housing, a rotor situated in the pump housing and rotatable by means of a drive shaft, and also blade elements which are accommodated so that they slide in grooves on the periphery of the rotor, and which interact in a sealing manner with a fixed cam surface, which pump housing is composed of three pump housing parts tightly connected to each other, the central pump housing part containing the cam surface Such a rotary pump is known from U.S. Pat. No. 2,766,700. One of the outer pump housing parts of said pump contains a port plate provided with either supply ports, or discharge ports. Said port plate rests both against the central housing part, as well as against the blade elements contained in said central housing part. In order to achieve a proper sealing of the port plate both with respect to said central pump housing port, as well as with respect to said blade elements, very accurate machining of all constructional elements is required. This causes the disadvantage of relative high manufacturing costs, and a complicated construction.

The aim of the invention is therefore to provide a rotary pump which lacks these disadvantages. This is achieved in that a port plate is provided with supply ports and discharge ports, and in that the port plate is accommodated in the central pump housing part.

Both the port plate and the blade elements now being contained in the central housing part, it is sufficient to properly machine these elements in order to obtain the required accuracy.

In particular, the rotary pump according to the invention is preferably designed in such a way that the blade elements rest with one of their side faces against an end face which is formed by the inward-facing surface of an outer pump housing part. This means that no port plate is necessary at that side of the blade elements. Moreover, it is not necessary to machine ports or channels in the outer housing part lying at the side facing away from the port plate. At their other side face the blade elements do rest against a port plate provided with supply ports and discharge ports.

In an economical variant, supply apertures and discharge apertures which correspond to the supply ports and discharge ports in the port plate are provided at least in the pump housing part lying at the side where the port plate is situated. The inside face of the other outer pump housing part can be entirely flat in this case, which simplifies its manufacture considerably.

In the case of the embodiment described above, the filling of the cavities in the pump chamber between rotor, cam face and blade elements takes place from only one side of the blade elements. In many cases the pumping action supplied in this case will already be sufficient. Nevertheless, the capacity can still be increased, while retaining a relatively simple design of pump. In that case at least one discharge aperture and one supply aperture are also provided in the inside wall of the outer pump housing part facing away from the port plate. The radial distance of said apertures from the drive shaft preferably corresponds to that of the outer ports of the pairs of ports in the port plate.

The filling of the cavities lying furthest out in the radial direction now takes place from two sides. In the cavities lying further in filling still takes place from one side. However, this is less of a drawback for providing a greater capacity, since the filling is favourably influenced there by the centrifugal forces occurring in operation of the pump.

Use of supply and discharge apertures at the side facing away from the port plate, at two radial distances from the drive shaft, is possible, but it is not so desirable from the manufacturing point of view.

The rotary pump according to the invention is particularly suitable for use in a continuously variable transmission.

The invention will be explained in greater detail below with reference to an example of an embodiment shown in the figures.

BRIEF DESCRIPTION OF THE INVENTION

DETAILED DESCRIPTION OF THE INVENTION

Figure 1:
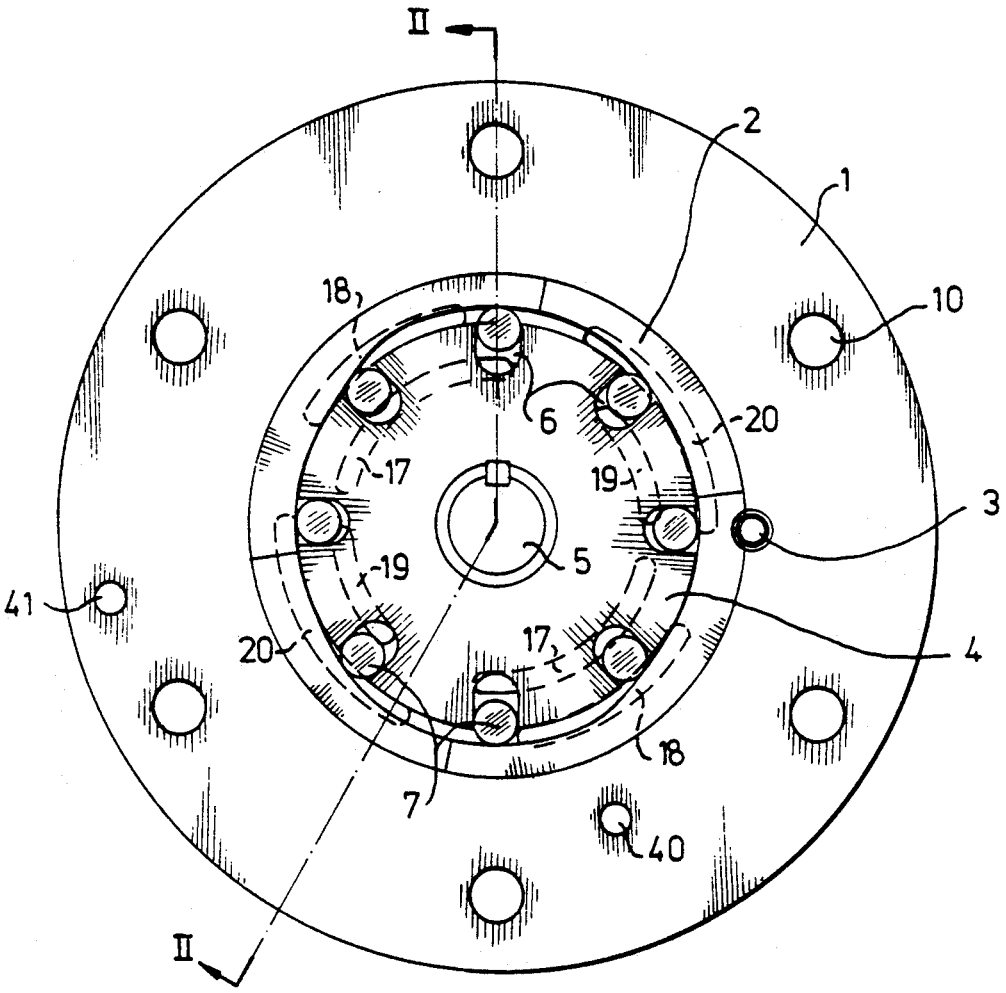
FIG. 1 shows a view of the inner pump mousing part.

In the view shown in FIG. 1 the inner pump housing part is indicated by 1. A cam ring 2 is accommodated in said pump housing part 1, and is fixed therein so that it cannot turn by means of locking pin 3 or another fixing device. One of the bolts 10 extending through the housing can also be used as the fixing device. The rotor 4 is fixed rotatably inside the cam ring 2. The rotor 4 can be driven by means of drive shaft 5.

The rotor 4 has a number of grooves 6, in each of which a blade element in the form of a roller 7 is accommodated in such a way that it can slide and rotate. The rollers 7 also rest on the inner surface of the cam ring 2, and on rotation of rotor 4 always slide between positions lying a greater or lesser distance outwards, depending on the curve of said inner surface.

Figure 2:
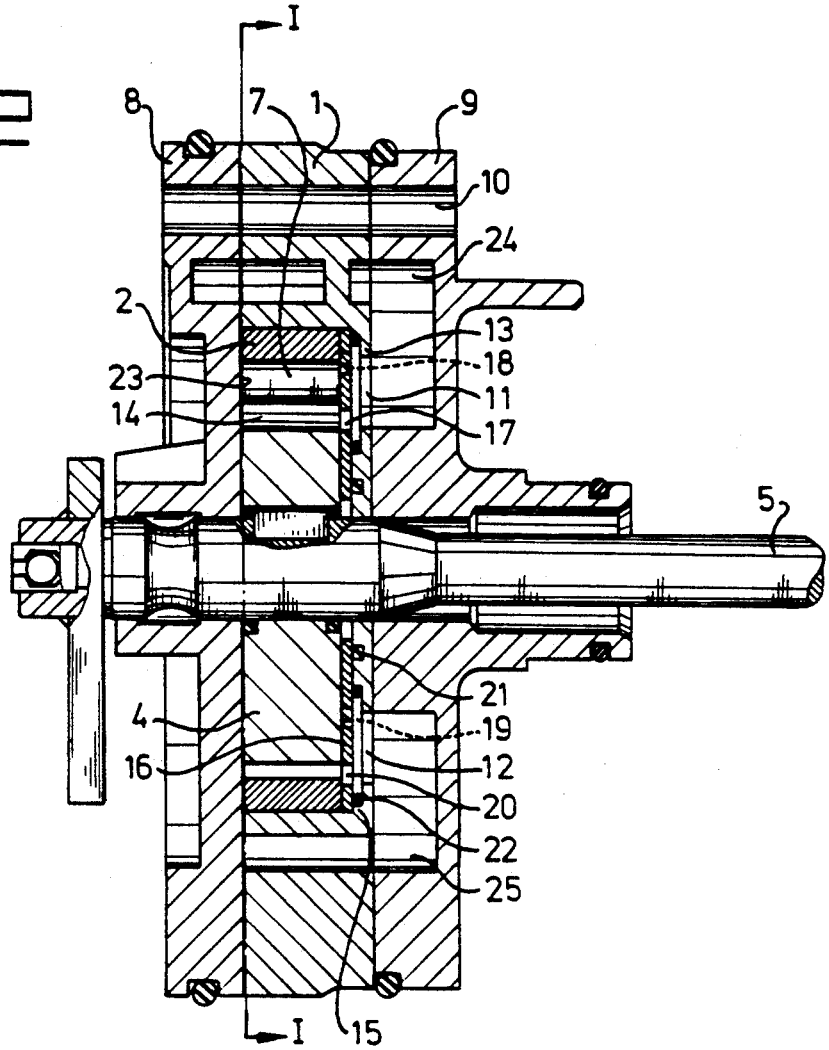
FIG. 2 shows a cross-section through the complete pump housing along the line II—II of FIG. 1.

As shown in FIG. 2, the pump housing consists of the central pump housing part 1 and the outer pump housing parts 8 and 9 lying on either side thereof. These three pump housing parts 1, 8, 9 can be clamped tightly on one another by means of bolts which are not shown, and which can be fitted in the passages 10. In the outer peripheral part of the pump, where the passages 10 for the bolts are also provided, sufficient space is available for other passages 40, 41, e.g. hydraulic lines of the hydraulic system of which the pump can also form part. The pump can consequently be used in complex hydraulic systems without complicated machining operations, for example such systems as are used in continuously variable transmissions (CVT). Where the pump is used in a CVT, it is possible to convey, for example, the clutch pressure, the primary pressure the engine pitot pressure and the oil lubrication pressure through the housing of the pump.

The central pump housing part 1 has supply apertures 11 for the medium to be pumped, and also has discharge apertures 12. These apertures are provided in the wall 13, which bounds the pump chamber 14 present in the central pump housing part 1 at one side.

A port plate 16 bounds said wall 14, preferably with some play, in particular resting against the recessed edges 15 thereof. This port plate 16 is in turn provided with supply ports 17, 18 which correspond to supply aperture 11, and is also provided with discharge ports 19, 20 which correspond to discharge aperture 12. The position of said supply ports 17, 18 and discharge ports 19, 20 is also shown diagrammatically in the view of FIG. 1. The port plate is sealed relative to the wall 13 by means of gaskets 21, 22. The rollers 7 lie with their one side against the port plate 16, and with their other side against the inside wall 23 of pump housing part 8. Said wall 23 can therefore be completely flat. The supply and discharge of the medium to be pumped in this case take place entirely at the side of the other outer pump housing part 9. The latter is provided with supply channels 24 and discharge channels 25 for this purpose. These channels 24, 25 are in turn connected to connections (not shown) on the outside of the pump housing.

Figure 3:
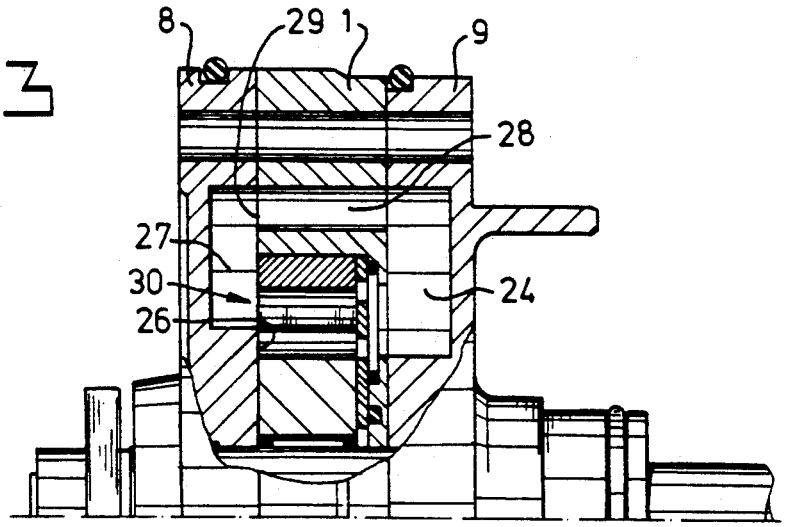
FIG. 3 shows a variant corresponding to the cross-section of FIG. 2.

In the case of the variant shown in FIG. 3 the inside wall 26 of the outer pump housing part is not made completely flat. Said wall 26 is now provided with a supply channel 27, which is connected by means of passage 28 in the central pump housing part 1 to the supply channel 24 in the outer pump housing part 9. The channel 27 opens out on the inside wall 26 at aperture 29, which connects to passage 28, and also at supply aperture 30 at the level of the rollers 7. The supply aperture 30 forms an additional supply for the medium to be pumped, and is provided at the same radial height as supply aperture 18. Correspondingly, an additional discharge aperture together with discharge channel connected via a corresponding passage to discharge channel 25 are, of course, also provided. However, the latter are not visible in the figure. Several discharge apertures and/or supply apertures can also be provided, as in the case of the port plate.

We claim:

1. In a rotary pump provided with a pump housing, a rotor (4) situated in the pump housing and rotatable by means of a drive shaft (5), and also blade elements (7) which are accommodated so that they slide in grooves (6) on the periphery of the rotor (4), and which interact in a sealing manner with a fixed cam surface (2), which pump housing is composed of three pump housing parts (1, 8, 9) tightly connected to each other, a central said pump housing part (1) between the other two housing parts (8, 9) containing the cam surface (2); the improvement wherein the pump further comprises a port plate (16) having supply ports (17, 18) and discharge ports (19, 20), the central pump housing part (1) having an end wall (13) containing supply apertures (11) and discharge apertures (12), and wherein the port plate at the side facing away from the blade elements (7) adjoins said end wall (13).

2. Rotary pump according to claim 1, in which the blade elements (7) rest with one of their side faces against an end face which is formed by an inward-facing surface (23) of an outer pump housing part (8).

3. Rotary pump according to claim 1, in which between the port plate (16) and end wall (13) gaskets (22) are provided surrounding one or more port apertures (11, 12).

4. Rotary pump according to claim 1, in which supply apertures (11) and discharge apertures (12) are provided in the central pump housing part (1) at least at the side at which the port plate (16) is situated, said apertures 911, 12) corresponding to the supply ports (17, 18) and discharge ports (19, 20) in the port plate (16).

5. Rotary pump according to claim 4, in which at least one discharge aperture and one supply aperture (30) are provided in the central pump housing part (1) facing away from the port plate (16).

6. Rotary pump according to claim 5, in which a discharge aperture and a supply aperture (30) in the central pump housing part (1) facing away from the port plate (16) are at a radial distance from the drive shaft (5) which corresponds to that of the outer ports (18, 20) of the pairs of ports in the port plate (16).

7. Rotary pump according to claim 4 in which an outer pump housing part (9) lying at a side of the port plate (16) contains a supply channel (24) connected to the supply apertures (11) in the central housing part (1), as well as a discharge channel (25) connected to the discharge apertures (12) in said housing part (1).

8. Rotary pump according to claim 7, in which an outer pump housing part (8) lying at a side facing away from the port plate (16) contains a supply channel (27) connected to a supply aperture (30) and to supply channel (24) in the other outer pump housing part (9) via a passage (28) in the central pump housing part (1), as well as a discharge channel connected to a discharge aperture and to discharge channel (25) in said other outer pump housing part (9) via a passage in the central housing part (1).

9. Rotary pump according to claim 1, in which the pump housing parts (1, 8, 9) are interconnected by one or more bolts, and at least one of these bolts fixes a cam ring defining the cam surface in the central pump housing part, in such a way that said cam ring cannot turn.

* * * * *